US010480250B2

(12) United States Patent
Milligan

(10) Patent No.: US 10,480,250 B2
(45) Date of Patent: Nov. 19, 2019

(54) BORE TUBE FOR A PRESSURE COMPENSATION SYSTEM IN A ROLLER CONE DRILL BIT

(71) Applicant: Halliburton Energy Services, Inc., Houston, TX (US)

(72) Inventor: Robin Brian Milligan, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 38 days.

(21) Appl. No.: 15/548,122

(22) PCT Filed: Mar. 6, 2015

(86) PCT No.: PCT/US2015/019203

§ 371 (c)(1),
(2) Date: Aug. 2, 2017

(87) PCT Pub. No.: WO2016/144294

PCT Pub. Date: Sep. 15, 2016

(65) Prior Publication Data

US 2018/0030784 A1 Feb. 1, 2018

(51) Int. Cl.
*E21B 10/24* (2006.01)
*E21B 10/25* (2006.01)

(52) U.S. Cl.
CPC ..... *E21B 10/24* (2013.01); *E21B 10/25* (2013.01)

(58) Field of Classification Search
None
See application file for complete search history.

(56) References Cited

U.S. PATENT DOCUMENTS 3,007,750 A * 11/1961 Cunningham ..... E21B 10/24 175/227
3,648,670 A * 3/1972 Siddons ..... F02B 57/00 123/43 R
4,386,667 A 6/1983 Millsapps, Jr.
4,738,323 A 4/1988 Mathews
5,240,083 A * 8/1993 Lyon ..... E21B 4/14 175/324

(Continued)

FOREIGN PATENT DOCUMENTS

CN 103233682 8/2013
WO 99/039075 8/1999

OTHER PUBLICATIONS

Office Action for Chinese Patent Application No. 201580071015.X, dated Sep. 5, 2018 (no English translation); 6 pages.

(Continued)

*Primary Examiner* — David J Bagnell
*Assistant Examiner* — Yanick A Akaragwe
(74) *Attorney, Agent, or Firm* — Baker Botts L.L.P.

(57) ABSTRACT

The disclosure relates to a bore tube for a pressure compensation system in a roller cone drill bit. The bore tube includes a bit body having at least one support arm extending therefrom, a lubricant chamber in each support arm, a bore in each support arm extending from to the lubricant chamber to an exterior surface of each support arm, a tube in the bore of each support arm, and a floating bead in the tube and operable to move axially within the tube in response to a pressure of the environment surrounding the roller cone drill bit.

14 Claims, 4 Drawing Sheets

(56) References Cited

U.S. PATENT DOCUMENTS

| | | | |
|---|---|---|---|
| 5,441,120 | A | 8/1995 | Dysart |
| 5,490,570 | A | 2/1996 | Millsapps |
| 5,513,715 | A | 5/1996 | Dysart |
| 6,206,110 | B1 | 3/2001 | Slaughter, Jr. et al. |
| 6,626,251 | B1 | 9/2003 | Sullivan et al. |
| 6,695,079 | B2 | 2/2004 | Portwood et al. |
| 6,789,634 | B1 | 9/2004 | Denton |
| 7,188,691 | B2 | 3/2007 | Yong et al. |
| 7,665,547 | B2 | 2/2010 | Yong et al. |
| 8,347,986 | B2 | 1/2013 | Anderele |
| 8,672,060 | B2 | 3/2014 | Centala et al. |
| 8,789,623 | B2 | 7/2014 | Duckworth et al. |
| 2005/0045387 | A1 | 3/2005 | Oliver et al. |
| 2008/0041630 | A1 | 2/2008 | Peterson |
| 2011/0187058 | A1 | 8/2011 | Curry et al. |
| 2014/0102790 | A1 | 4/2014 | Lee |

OTHER PUBLICATIONS

Besson, et al. "On the Cutting Edge", Oilfield Review, Dec. 31, 2000; 22 pages.

International Search Report and Written Opinion for PCT Patent Application No. PCT/US2015/019203, dated Nov. 23, 2015; 11 pages.

* cited by examiner

BORE TUBE FOR A PRESSURE COMPENSATION SYSTEM IN A ROLLER CONE DRILL BIT

RELATED APPLICATIONS

This application is a U.S. National Stage Application of International Application No. PCT/US2015/019203 filed Mar. 6, 2015, which designates the United States, and which is incorporated herein by reference in its entirety.

TECHNICAL FIELD

The present disclosure is related to roller cone drill bits and more particularly to a pressure compensation system in a roller cone drill bit.

BACKGROUND OF THE DISCLOSURE

A roller cone drill bit is one type of drill bit used to form wellbores in subterranean formations. A roller cone drill bit generally includes at least one support arm, and often includes up to three support arms. A respective cone assembly may be rotatably mounted on the interior portions of each support arm and may rotate around the interior portions of the support arm.

Each cone assembly often includes a base with a cavity or opening formed therein. Each cone cavity may be sized to receive exterior portions of an associated journal or spindle to allow rotation of the cone assembly relative to the associated journal or spindle during a subterranean operation. A wide variety of bearings, bearing assemblies, bearing surfaces, seals, and/or other supporting structures may be disposed between interior portions of each cone assembly and exterior portions of the associated journal or spindle.

Roller cone drill bits often include lubricant systems to supply lubricant to the journals, bearings, bearing assemblies, bearing surfaces, seals, and/or other supporting structures associated with rotation of each cone assembly mounted on a respective support arm. A variety of lubricants may be used with roller cone drill bits to accommodate the rotation of each cone assembly relative to the respective spindle. A wide variety of seals and seal assemblies may be used to block communication between downhole wellbore fluids (e.g., drilling fluids and/or hydrocarbons) and lubricants associated with the rotation of each cone assembly. Various types of systems have been used to maintain lubricant system pressure to minimize potential damage to bearings, bearing assemblies, seals, journals, and other supporting structures associated with rotation of a cone assembly relative to an associated support arm.

BRIEF DESCRIPTION OF THE DRAWINGS

For a more complete understanding of the present invention and its features and advantages reference is now made to the following description, taken in conjunction with the accompanying drawings, in which like reference numbers indicate like features, and wherein.

DETAILED DESCRIPTION OF THE DISCLOSURE

The present disclosure relates to a bore tube for a pressure compensation system in a roller cone drill bit, including hybrid drill bits that combine features of conventional roller cone drill bits with features of other types of bits. The inner surface of the tube may have a substantially smooth surface texture. The tube may be inserted in a bore disposed within a support arm of the drill bit. A floating bead may be disposed within the tube and may travel axially in the tube in response to pressure changes in the environment surrounding the drill bit. Due to the smooth surface of the tube, friction between the floating bead and the surface of the tube may be minimized such that the floating bead moves freely. The responsiveness of the floating bead may provide improved pressure communication for the pressure compensation system and therefore may result in increased drill bit performance and reliability. Additionally, the tube may be simple to manufacture and may simplify the assembly of the drill bit, thus reducing the cost and time used to assemble the drill bit. The present disclosure and associated advantages may be understood by reference to FIGS. 1 through 3B wherein like numbers refer to same and like parts.

Figure 1:
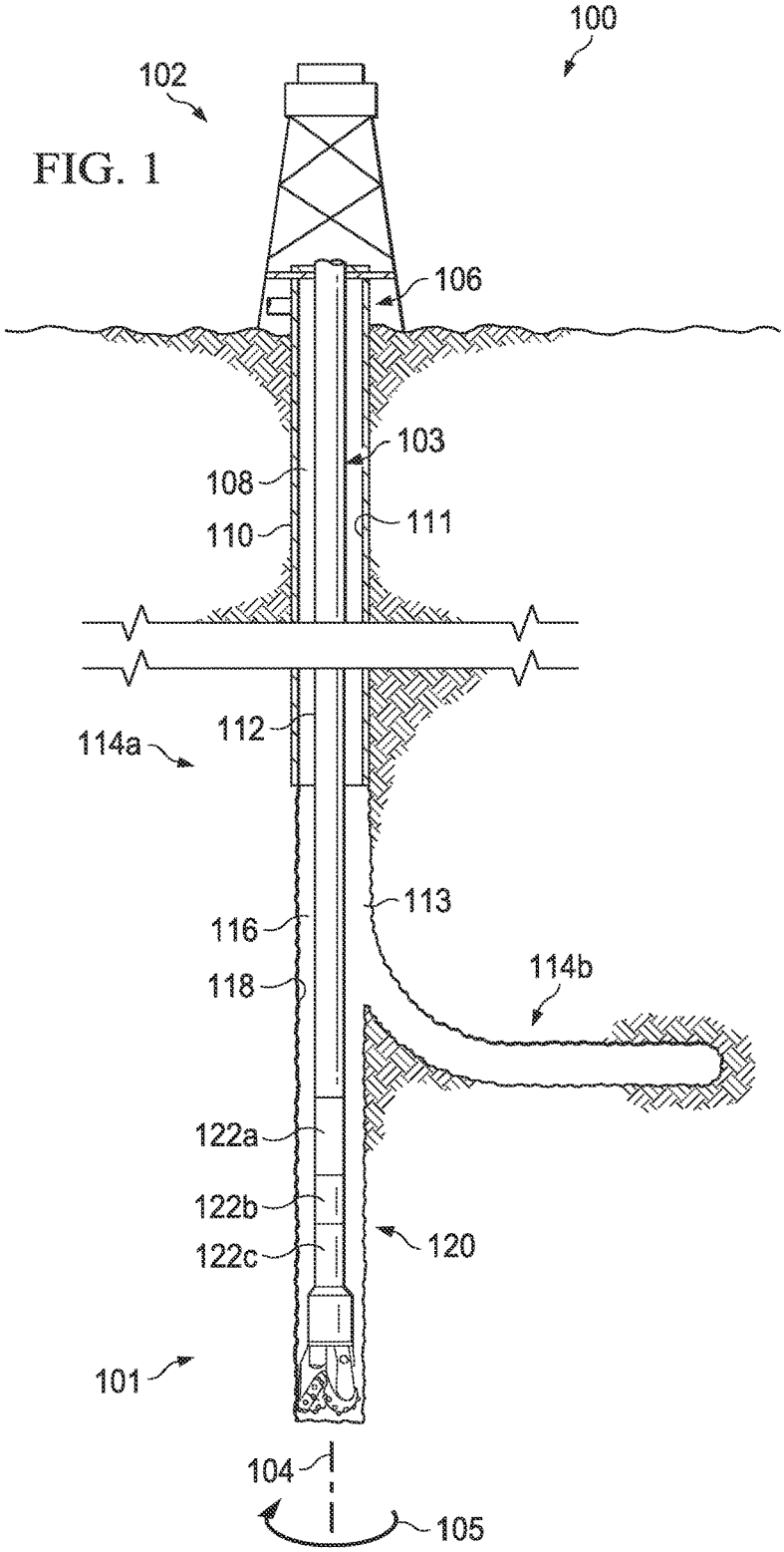
FIG. 1 is an elevation view of a drilling system.

FIG. 1 is an elevation view of a drilling system. Drilling system 100 may include a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a "land drilling rig." However, drill bits incorporating teachings of the present disclosure may be satisfactorily used with drilling equipment located on offshore platforms, drill ships, semi-submersibles, and/or drilling barges (not expressly shown).

Drilling system 100 may include drill string 103 associated with drill bit 101 that may form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may form horizontal wellbore 114*b*. For example, lateral forces may be applied to BHA 120 proximate kickoff location 113 to form generally horizontal wellbore 114*b* extending from generally vertical wellbore 114*a*. The term "directional drilling" may describe drilling a wellbore or portions of a wellbore that extend at a desired angle or angles relative to vertical. Such angles may be greater than normal variations associated with vertical wellbores. Direction drilling may also be described as drilling a wellbore deviated from vertical. The term "horizontal drilling" may include drilling in a direction approximately ninety degrees (90°) from vertical.

BHA 120 may be formed from a wide variety of components configured to form wellbore 114. For example, components 122*a*, 122*b* and 122*c* of BHA 120 may include, but are not limited to, drill bits (e.g., drill bit 101), coring bits, drill collars, rotary steering tools, directional drilling tools, downhole drilling motors, reamers, hole enlargers, or stabilizers. The number and types of components 122 included in BHA 120 may depend on anticipated downhole drilling conditions and the type of wellbore that will be formed by drill string 103 and drill bit 101.

Drilling system 100 may also include roller cone drill bit ("drill bit") 101. Drill bit 101, discussed in further detail in FIGS. 2, 3A, and 3B, may include one or more support arms that may extend downward from exterior portions of the bit body of drill bit 101. The bit body may be generally cylindrical and the support arms may be any suitable type of projections extending downwardly from the bit body. Drill bit 101 may rotate with respect to bit rotational axis 104 in a direction defined by directional arrow 105. Each support arm may include a cone assembly rotatably disposed thereon. Cutting action associated with forming wellbore 114 in a downhole formation may occur as the cone assemblies engage and roll around the bottom or downhole end of wellbore 114 in response to rotation of drill bit 101. Drill bit 101 may be designed and formed in accordance with teachings of the present disclosure and may have many different designs, configurations, and/or dimensions according to the particular application of drill bit 101.

Figure 3A:
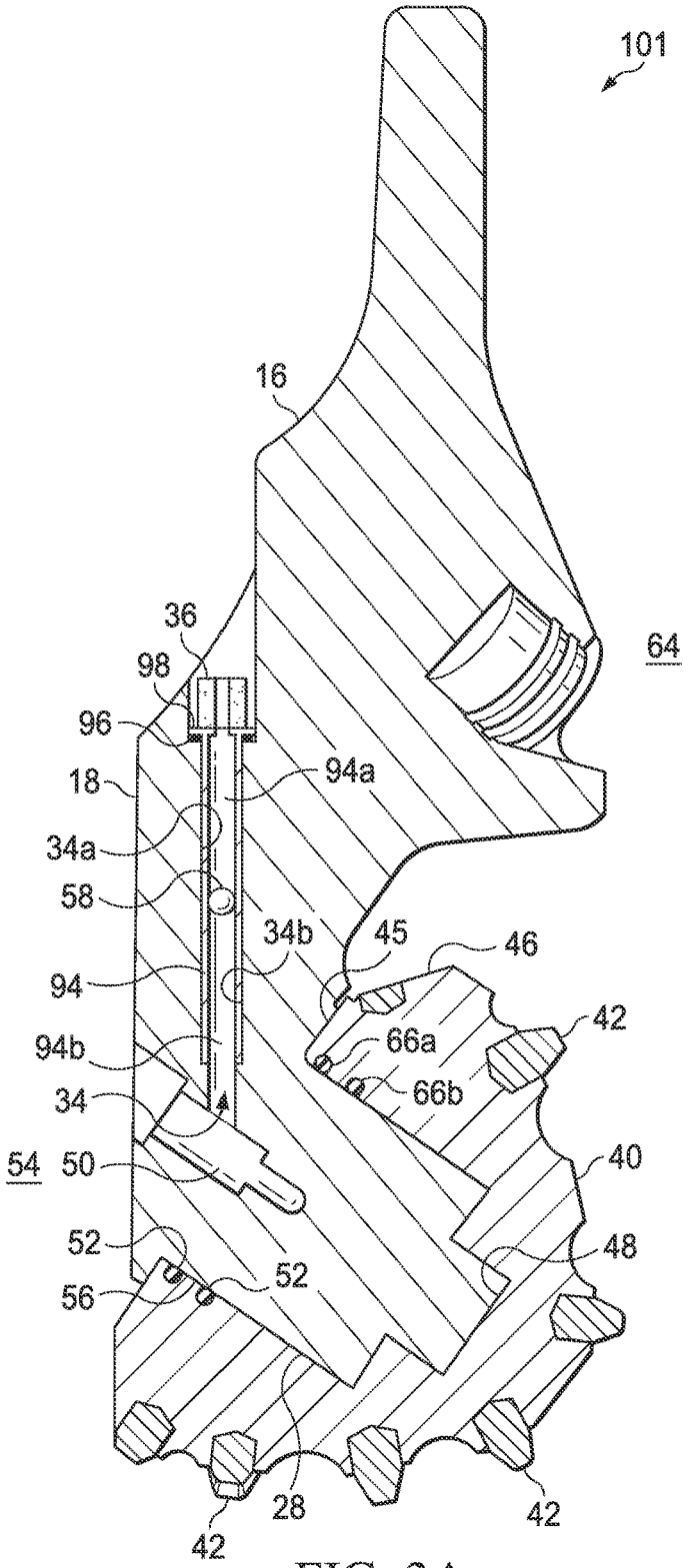
FIG. 3A is a schematic drawing in section with portions broken away showing various components of a roller cone drill bit and an associated lubrication system incorporating a bore tube and a floating bead.
Figure 3B:
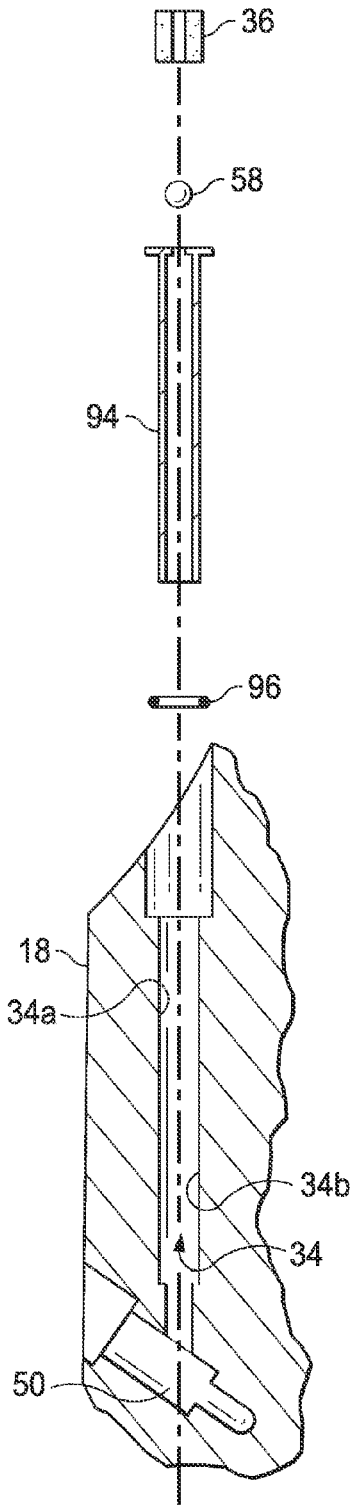
FIG. 3B is an exploded view in section with portions broken away showing various components of a roller cone drill bit and an associated lubrication system incorporating a bore tube and a floating bead.

Drill bit 101 may include an internal lubrication system, as described in more detail with respect to FIGS. 3A and 3B, which provides lubrication to the junction between each support arm and its respective cone assembly. The lubrication system may also include a pressure compensation system which may maintain the lubricant in the lubrication system at approximately the same pressure as the wellbore environment surrounding drill bit 101. The pressure compensation system may include a bead floating within a tube. The inner diameter of the tube may have a substantially smooth surface texture such that the friction between the bead and the tube is minimized as the bead travels within the tube.

Figure 2:
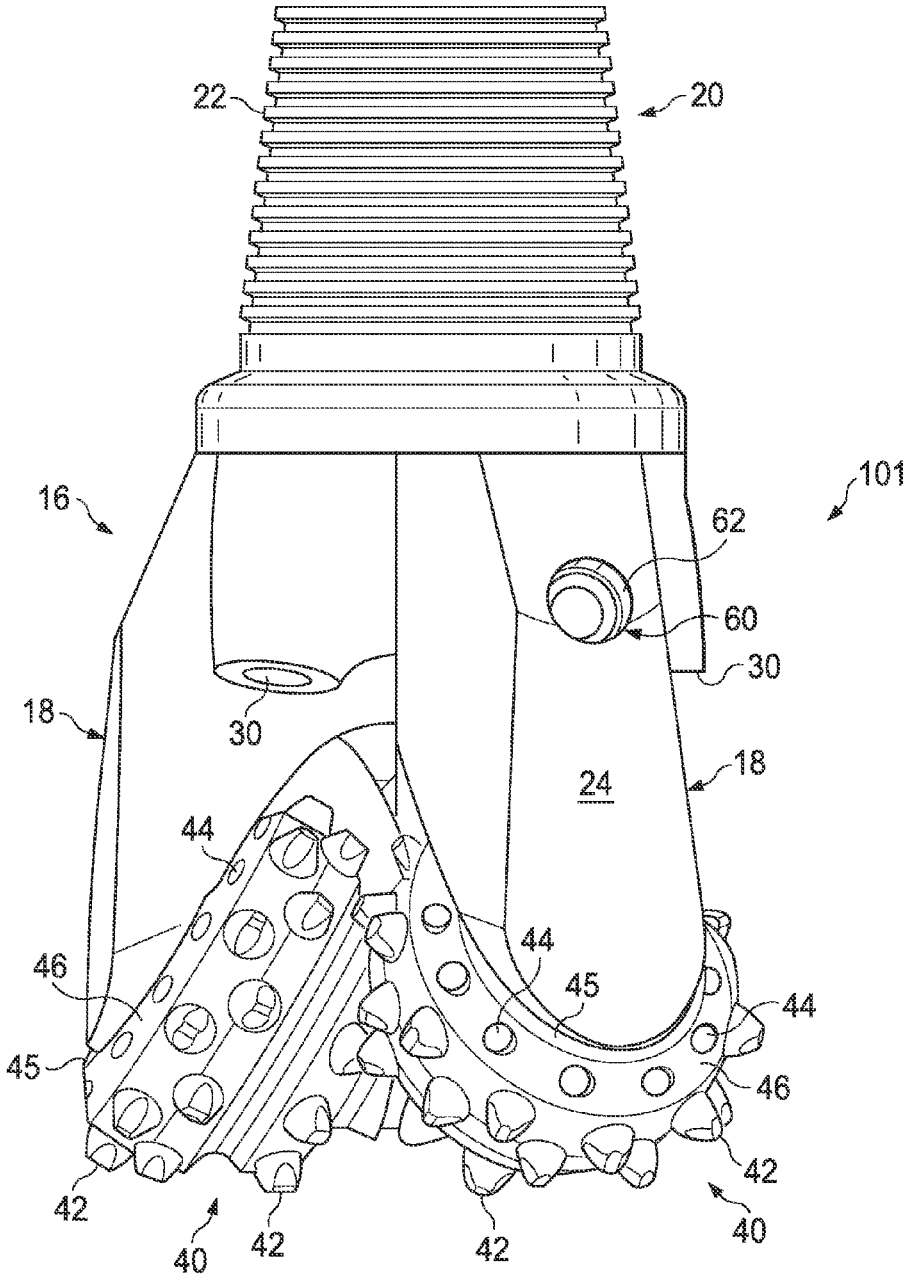
FIG. 2 is a schematic drawing showing an isometric view of one example of a roller cone drill bit.

FIG. 2 is a schematic drawing showing an isometric view of one example of roller cone drill bit 101. Drill bit 101 as shown in FIGS. 1 through 3B may also be referred to as a "roller cone drill bit," "rotary cone drill bit," "rotary rock bit," and/or "rock bit." Drill bit 101 may include various types of such bits. Roller cone drill bits may have at least one support arm with a respective cone assembly rotatably disposed thereon.

Each cone assembly 40 may be attached with and rotate relative to exterior portions of associated spindle or journal 28, as shown in FIG. 3A. Cone assembly 40 may be referred to as a "roller cone," "rotary cone cutter," "roller cone cutter," "rotary cutter assembly," and/or "cutter cone assembly." Each of cone assemblies 40 may include a plurality of cutting elements or inserts 42 which penetrate and scrape against adjacent portions of a downhole formation in response to rotation of drill bit 101. Referring to FIGS. 2 and 3, cone assemblies 40 may also include a plurality of compacts 44 disposed on respective gauge surface 46 of each cone assembly 40. Cutting elements 42 may include various types of compacts, inserts, milled teeth, and welded compacts satisfactory for use with roller cone drill bits. Cone assembly 40 may also include generally circular base portion 45.

Drill bit 101 may include bit body 16 having three support arms 18 extending therefrom. Only two support arms 18 may be seen in FIG. 2 but the teachings of the present disclosure may be used in drill bits with various numbers of support arms 18. Uphole portion or pin end 20 of drill bit 101 may include generally tapered, external threads 22. Threads 22 may be releasably engage drill bit 101 with the downhole end of an associated drill string, including drill string 102 in FIG. 1, or bottomhole assembly, including BHA 120 in FIG. 1.

Formation materials and other downhole debris created during impact between cutting elements or inserts 42 and adjacent portions of a downhole formation may be carried from the bottom or end of an associated wellbore by drilling fluid flowing from nozzles 30.

Each support arm 18 may include a respective lubricant system 60. Lubricant may refer to any fluid, grease, composite grease, or mixture of fluids and solids satisfactory for lubricating journal bearings, thrust bearings, bearing surfaces, bearing assemblies, and/or other supporting structures associated with rotatably mounting one or more cone assemblies on a roller cone drill bit. Lubricant system 60 may include external end or opening 62 adjacent to exterior portion 24 of associated support arm 18.

FIG. 3A is a schematic drawing in section with portions broken away showing various components of roller cone drill bit 101 and an associated lubrication system incorporating bore tube 94 and floating bead 58 and FIG. 3B is an exploded view in section with portions broken away showing various components of a roller cone drill bit and an associated lubrication system incorporating bore tube 94 and floating bead 58. Each cone assembly 40 may be rotatably mounted on associated spindle or journal 28 in a substantially similar manner. Accordingly, only one support arm 18, journal 28, and cone assembly 40 will be described in detail. Cone assembly 40 may include generally circular base portion 45 with cavity 48 extending inwardly therefrom. Cavity 48 (sometimes referred to as a "cone cavity") may have a generally cylindrical configuration sized to receive exterior portions of associated spindle or journal 28 therein. Associated gage surface 46 may extend radially outward and be tapered relative to respective base portion 45.

Each support arm 18 may include respective exterior surface 54 and interior surface 64 which are normally exposed to downhole wellbore fluids, including drilling fluids and/or hydrocarbons while forming a wellbore or during another subterranean operation. Each support arm 18 may include respective journal 28 formed as an integral component thereof. Respective cone assembly 40 may be rotatably mounted on each spindle or journal 28. Each spindle or journal 28 may be angled downwardly and inwardly with respect to bit rotational axis 12 of associated support arm 18 so that attached cone assembly 40 may engage the bottom or downhole end of a wellbore during rotation of drill bit 101. For some applications, spindle or journal 28 may also be tilted at an angle of zero to three or four degrees in the direction of rotation of drill bit 101.

A wide variety of supporting structures and/or bearing surfaces may be used to rotatably mount each cone assembly 40 on associated spindle or journal 28. For example, retaining balls (not expressly shown) may be used between cone assembly 40 and spindle or journal 28 to secure cone assembly 40 on support arm 18. For some applications, the retaining balls may be a journal bearing or as a thrust bearing. For some subterranean applications, bearing surfaces associated with rotatably mounting a roller cone assembly on a spindle or journal may be formed as integral components (not expressly shown) disposed on exterior portions of an associated journal and interior portions of a cavity formed within an associated roller cone assembly.

Seals 66*a* and 66*b* may prevent debris and well fluids from entering annular gap 56 formed radially between cone assembly 40 and journal 28. Seals 66*a* and 66*b* may be received in glands or grooves 52 formed in cone assembly 40. Seals 66*a* and 66*b* may be located in cavity 48 proximate an opening in base portion 45 of cone assembly 40. Seals 66*a* and 66*b* may be elastomeric seals and may form a fluid seal or fluid barrier between adjacent interior portions of cavity 48 and adjacent exterior portions of journal 28. Seals 66*a* and 66*b* may prevent downhole wellbore fluids, including drilling fluid and/or hydrocarbons, formation cuttings, and/or downhole debris from entering cavity 48 and damaging associated bearing surfaces and supporting structures. Although two seals 66*a* and 66*b* are depicted in the drawings, any number of seals (including one) may be used in keeping with the scope of this disclosure. The terms "seal" or "fluid seal" refer to a wide variety of seals and seal assemblies including, but not limited to, an O-ring seal, T-seal, V-seal, flat seal, lip seal, and/or any other seal or seal assembly operable to establish a fluid barrier between adjacent components or sealing surfaces.

As cone assembly 40 rotates about the journal 28, seals 66*a* and 66*b* may rotate with cone assembly 40 and seal against an outer surface of journal 28 or seals 66*a* and 66*b* may remain stationary on the journal 28 (for example, the seals may be disposed in grooves formed on the journal), with cone assembly 40 rotating relative to journal 28 and seals 66*a* and 66*b*.

If damage occurs to journals, spindles, bearings, bearing assemblies, bearing surfaces, seals, and/or other supporting structure associated with rotation of a roller cone or cone assembly relative to an associated support arm and/or lubrication systems to protect such components, the associated roller cone drill bit and attached drill string may generally be removed from the wellbore to replace damaged components and/or to replace the roller cone drill bit. Therefore, drill bit 101 may include a lubrication system which provides lubrication to seals, bearings, journals, bearing surfaces, bearing assemblies, and/or other supporting structures associated with rotation of a roller cone assembly relative to the associated support arm. The lubrication system may include both a primary pressure compensation system and a secondary pressure compensation system. Both pressure compensation systems may provide pressure equalization between the pressure of the lubricant in the lubrication system and the pressure of the wellbore environment surrounding drill bit 101. Maintaining substantially equal pressure between the wellbore environment and the lubricant may prevent wellbore fluids (e.g., drilling fluids and/or hydrocarbons) from entering the interior of drill bit 101 and prevent lubricant from exiting the lubrication system.

Filling a lubrication system with lubricant and maintaining desired lubrication in accordance with teachings of the present disclosure may increase the downhole drilling life of a roller cone drill bit by maintaining desired lubrication related to seals, bearings, journals, bearing surfaces, bearing assemblies, and/or other supporting structures associated with rotation of a roller cone assembly relative to the associated support arm. In a lubrication system, lubricant may be supplied to retaining balls from fluidly coupled lubricant chamber 50 such that lubricant flows from lubricant chamber to retaining balls. Lubricant chamber 50 may be sealed by a ball plug (not expressly shown). A primary pressure compensation system for drill bit 101 may include a lubricant reservoir (not expressly shown) and a bore (not expressly shown) may provide fluid communication between the lubricant reservoir and lubricant chamber 50.

A secondary pressure compensation system for drill bit 101 may include bore 34 created in support arm 18. Bore 34 may extend from lubricant chamber 50 to an exterior surface, including exterior surface 54, of support arm 18. The surface of the inner diameter of bore 34 may have any suitable surface texture and may include grooves created during the manufacturing process. The size, including length and diameter, of bore 34 may be constrained by the size of support arm 18.

Tube 94 may be inserted in bore 34. Tube 94 may be a cylindrical shape and may be hollow in the center, having an outer diameter and an inner diameter. The thickness of the wall of tube 94 (i.e. the difference between the outer diameter and the inner diameter of tube 94) may be any suitable thickness such that tube 94 may have sufficient rigidity to maintain the shape of tube 94 during a subterranean operation. Tube 94 may be manufactured such that the surface of inner diameter of tube 94 is substantially smooth. For example, tube 94 may be extruded. A substantially smooth surface texture for the inner perimeter of tube 94 may minimize the friction between the surface of the inner perimeter of tube 94 and floating bead 58. Tube 94 may be cut from a larger piece of a seamless tube. Alternatively, tube 94 may be manufactured individually to a specified length. Tube 94 may be formed from any suitable material that is corrosion resistant and/or capable of withstanding the conditions in the wellbore, such as a stainless steel. While the surface of the inner perimeter of tube 94 may be substantially smooth, the surface of the outer perimeter of tube 94 may have any surface texture.

Tube 94 may have a flared end 98. Flared end 98 may maintain the position of tube 94 in bore 34 and may prevent tube 94 from being inserted too far into bore 34. While the flare of flared end 98 is shown in FIGS. 3A and 3B as being disposed at an angle of approximately 90 degrees with reference to the length of tube 94, the flare of flared end 98 may be disposed at any angle relative to the length of tube 94.

Flared end 98 may also maintain the position of seal 96. The space between the wall of bore 34 and the outer perimeter of tube 94 may be filled with lubricant and seal 96 may prevent the lubricant occupying the space between the wall of bore 34 and the outer perimeter of tube 94 from exiting the space. While seal 96 is shown in FIG. 3A as being located near flared end 98, seal 96 may be located at any axial position along tube 94. Seal 96 may be any suitable sealing device including, but not limited to, an O-ring seal, T-seal, V-seal, flat seal, lip seal and any other seal or seal assembly operable to establish a fluid barrier between adjacent components or sealing surfaces.

Tube 94 may have any suitable diameter such that tube 94 fits within the diameter of bore 34. The length of tube 94 may be based on the length of bore 34. Tube 94 may be designed such that tube 94 ends approximately the full length of bore 34 to maximize the amount of travel of floating bead 58, or tube 94 may extend less than the length of bore 34.

Floating bead 58 may be located in tube 94 and may move axially along the length of tube 94 based on the pressure of the downhole environment surrounding drill bit 101. Floating bead 58 may ensure that the lubricant in the lubrication system is at substantially the same pressure as the downhole environment at exterior 54 of drill bit 101, when drill bit 101 is being used in a subterranean operation. For example, in operation, the pressure of the wellbore fluids, including drilling fluids and/or hydrocarbons, surrounding drill bit 101 may increase and the increased pressure may force floating bead 58 to move axially in tube 94 in the direction of lubricant chamber 50. Alternatively, in environments where the pressure of the wellbore fluids surrounding drill bit 101 decease, floating bead 58 may move axially along tube 94 in a direction towards retainer 36. Retainer 36 may prevent floating bead 58 from being discharged out of bore 34 and/or tube 94, and may filter wellbore fluids which enter bore 34 and/or tube 94. Retainer 36 may additionally maintain the position of tube 94 within bore 34. Retainer 36 may be any suitable device, such as a national pipe thread (NPT) pipe fitting having a hole in the center, that prevents floating bead 58 and tube 94 from exiting support arm 18 while allowing wellbore fluids to enter section 94*a*.

Friction between floating bead 58 and the inner perimeter of tube 94 may cause some variation in pressure between the upper section 94*a* and lower section 94*b* of tube 94, however floating bead 58 may be displaced in tube 94 to relieve most pressure differentials across floating bead 58. The smooth surface texture of the inner perimeter of tube 94 may minimize the friction and thus minimize any pressure variations between sections 94*a* and 94*b*. Sections 94*a* and 94*b* of tube 94, discussed in further detail below, may be isolated from fluid communication with each other by the floating bead 58.

Floating bead 58 may be spherically-shaped, and may be spherically shaped, including full spheres or beads circular or ovoid in one cross-section, such that floating bead 58 can rotate without binding within tube 94 while maintaining a sealing engagement with the inner perimeter of tube 94. However, a circumferential portion which contacts tube 94 may be flattened somewhat or floating bead 58 may have other shapes, such as cylindrical, barrel-shaped, etc. Floating bead 58 may have any shape in keeping with the scope of this disclosure. Floating bead 58 may be made entirely or at least exteriorly of an elastomer or other resilient material, which will deform somewhat when it sealingly contacts tube 94. The size of floating bead 58 may be constrained based on the size of tube 94. For example, the size of floating bead 58 may be sufficiently large that floating bead 58 may maintain a seal with the surface of the inner perimeter of tube 94, but not so large that floating bead 58 may not move freely within tube 94 so as to relieve a pressure differential between the lubricant in the lubrication system and the downhole environment.

Floating bead 58 may define exterior section 94*a* of tube 94 and interior section 94*b* of tube 94. Accordingly, the precise location of sections 94*a* and 94*b* may change as floating bead 58 moves axially within tube 94. Interior section 94*b* of tube 94 may be included as part of lubricant chamber 50. Sections 94*a* and 94*b* of tube 94 may be isolated from fluid communication with each other by the floating bead 58. The pressure across floating bead 58 may become substantially equalized between sections 94*a* and 94*b*. With pressure substantially equalized between sections 94*a* and 94*b* of tube 94 it may be appreciated that a pressure across seals 66*a* and 66*b* may also be substantially zero because seals 66*a* and 66*b* may be exposed to the lubricant on one side, and may be exposed to exterior surface 54 of drill bit 101 on an opposite side.

The manufacturing process of creating the secondary pressure compensation system in support arm 18 may involve machining support arm 18 to create bore 34. For example, bore 34 may be milled, drilled, and/or bored into support arm 18. Bore 34 may be created using a rough machining process as the surface texture of bore 34 may be rough. Bore 34 may be machined to have a diameter larger than the outer diameter of tube 94. Bore 34 may extend from lubricant chamber 50 to an exterior surface, including exterior surface 54, of support arm 18. Bore 34 may have a larger diameter near the exterior surface of support arm 18. The larger diameter section may be designed to receive retainer 36.

After bore 34 is created in support arm 18, tube 94 may be inserted into bore 34. Tube 94 may have seal 96 located on the outer perimeter of tube 94 or seal 96 may be separately inserted into bore 34. Tube 94 may be inserted into bore 34 until flared end 98 is flush with an exterior surface (e.g., exterior surface 54) of support arm 18 or until flared end 98 is resting on the top of bore 34. Tube 94 may have been previously cut from a length of an extruded seamless tube. The length of tube 94 may be such that tube 94 extends substantially the full length of bore 34 and maximizes the range of travel of floating bead 58 or tube 94 may extend partially in bore 34.

After tube 94 is inserted in bore 34, floating bead 58 may be inserted in tube 94 or floating bead 58 may be inserted into bore 34 prior to tube 94 and may enter tube 94 after tube 94 is inserted in bore 34.

Once tube 94 and floating bead 58 have been inserted in bore 34, retainer 36 may be coupled to support arm 18 to prevent tube 94 and floating bead 58 from exiting bore 34. Retainer 36 may be a NPT pipe fitting, such as a ¼-inch NPT pipe fitting, with a hole in the center. The diameter of the hole in the center of retainer 36 may be smaller than the diameter of floating bead 58. Bore 34 may be machined to have threads for receiving retainer 36.

After assembly of bore 34, tube 94, floating bead 58, and retainer 36, lubricant chamber 50 and section 94*b* may then be filled with lubricant or lubricant chamber 50 may be filled with lubricant prior to the insertion of tube 94 and floating bead 58 into bore 34. In addition to filling lubrication chamber 50 and section 94*b*, the lubricant may also fill the space between the walls of bore 34 and the outer perimeter of tube 94. Seal 96 may prevent the lubricant from exiting the lubrication system from between the wall of bore 34 and the outer perimeter of tube 94.

Embodiments disclosed herein include:

A. A roller cone drill bit including a bit body having at least one support arm extending therefrom, a lubricant chamber in each support arm, a bore in each support arm extending from to the lubricant chamber to an exterior surface of each support arm, a tube in the bore of each support arm, and a floating bead in the tube and operable to move axially within the tube in response to a pressure of the environment surrounding the roller cone drill bit.

B. A method for lubricant pressure relief including relieving a pressure differential between a lubricant in a lubricant chamber and a wellbore environment whenever a pressure of the lubricant and a pressure of the wellbore environment is substantially unequal, wherein the pressure compensation mechanism is in a roller cone drill bit including: a bit body having at least one support arm extending therefrom, the lubricant chamber in each support arm, a bore in each support arm extending from to the lubricant chamber to an exterior surface of each support arm, a tube in the bore of each support arm, and a floating bead in the tube and operable to move axially within the tube.

C. A drilling system including a drill string and a roller cone drill bit. The roller cone drill bit includes a bit body having at least one support arm extending therefrom, a lubricant chamber in each support arm, a bore in each support arm extending from to the lubricant chamber to an exterior surface of each support arm, a tube in the bore of each support arm, and a floating bead in the tube and operable to move axially within the tube in response to a pressure of the environment surrounding the roller cone drill bit.

Each of embodiments A, B, and C may have one or more of the following additional elements in any combination: Element 1: further comprising a retainer located between an end of the tube and the exterior surface of each support arm. Element 2: further comprising a seal located between a wall of the bore and an outer perimeter of the tube. Element 3: wherein an end of the tube is flared. Element 4: wherein the tube is manufactured from stainless steel. Element 5: wherein a surface of an inner perimeter of the tube has a substantially smooth surface texture. Element 6: wherein the tube extends substantially the length of the bore.

Although the present disclosure and its advantages have been described in detail, it should be understood that various changes, substitutions and alternations can be made herein without departing from the spirit and scope of the disclosure as defined by the following claims. For example, while described with respect to a secondary pressure compensation system, aspects of this invention may be used in a primary pressure compensation system.

What is claimed is:

1. A roller cone drill bit comprising:

a bit body having at least one support arm extending therefrom;

a lubricant chamber in each support arm;

a bore in each support arm extending from to the lubricant chamber to an exterior surface of each support arm;

a tube in the bore of each support arm, the tube having an inner perimeter with a smooth surface texture;

a seal located between a wall of the bore and an outer perimeter of the tube to prevent a lubricant occupying a space between the wall of the bore and the outer perimeter of the tube from exiting the space; and a floating bead in the tube and operable to move axially within the tube in response to a pressure of the environment surrounding the roller cone drill bit.

2. The drill bit of claim 1, further comprising a retainer located between an end of the tube and the exterior surface of each support arm.

3. The drill bit of claim 1, wherein an end of the tube is flared.

4. The drill bit of claim 1, wherein the tube is manufactured from stainless steel.

5. The drill bit of claim 1, wherein the tube extends substantially the length of the bore.

6. A method for lubricant pressure relief comprising relieving a pressure differential between a lubricant in a lubricant chamber and a wellbore environment whenever a pressure of the lubricant and a pressure of the wellbore environment is substantially unequal, wherein the pressure compensation mechanism is in a roller cone drill bit including:

a bit body having at least one support arm extending therefrom;

the lubricant chamber in each support arm;

a bore in each support arm extending from to the lubricant chamber to an exterior surface of each support arm;

a tube in the bore of each support arm, the tube having an inner perimeter with a smooth surface texture;

a seal located between a wall of the bore and an outer perimeter of the tube to prevent a lubricant occupying a space between the wall of the bore and the outer perimeter of the tube from exiting the space; and a floating bead in the tube and operable to move axially within the tube.

7. The method of claim 6, wherein the roller cone drill bit further includes a retainer located between an end of the tube and the exterior surface of each support arm.

8. The method of claim 6, wherein an end of the tube is flared.

9. The method of claim 6, wherein the tube is manufactured from stainless steel.

10. The method of claim 6, wherein the tube extends substantially the length of the bore.

11. A drilling system comprising:

a drill string; and a roller cone drill bit including:

a bit body having at least one support arm extending therefrom;

a lubricant chamber in each support arm;

a bore in each support arm extending from to the lubricant chamber to an exterior surface of each support arm;

a tube in the bore of each support arm, the tube having an inner perimeter with a smooth surface texture;

a seal located between a wall of the bore and an outer perimeter of the tube to prevent a lubricant occupying a space between the wall of the bore and the outer perimeter of the tube from exiting the space; and a floating bead in the tube and operable to move axially within the tube in response to a pressure of the environment surrounding the roller cone drill bit.

12. The drilling system of claim 11, wherein the roller cone drill bit further includes a retainer located between an end of the tube and the exterior surface of each support arm.

13. The drilling system of claim 11, wherein an end of the tube is flared.

14. The drilling system of claim 11, wherein the tube is manufactured from stainless steel.

* * * * *